US011738578B2

(12) United States Patent
Yamaguchi

(10) Patent No.: US 11,738,578 B2
(45) Date of Patent: Aug. 29, 2023

(54) PRINTING APPARATUS AND PRINTING METHOD

(71) Applicant: Seiko Epson Corporation, Tokyo (JP)

(72) Inventor: Kenji Yamaguchi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/651,192

(22) Filed: Feb. 15, 2022

(65) Prior Publication Data

US 2022/0258500 A1 Aug. 18, 2022

(30) Foreign Application Priority Data

Feb. 18, 2021 (JP) ..... 2021-024179

(51) Int. Cl.

| | |
|---|---|
| ***B41J 15/04*** | (2006.01) |
| ***B41J 15/02*** | (2006.01) |
| ***B65H 16/06*** | (2006.01) |
| ***B65H 35/02*** | (2006.01) |
| *B41J 3/407* | (2006.01) |

(52) U.S. Cl.

CPC ..... *B41J 15/048* (2013.01); *B41J 15/02* (2013.01); *B65H 16/06* (2013.01); *B65H 35/02* (2013.01); *B41J 3/4078* (2013.01); *B65H 2301/412* (2013.01); *B65H 2301/41487* (2013.01); *B65H 2801/03* (2013.01)

(58) Field of Classification Search

CPC ..... B41J 15/048; B41J 15/02; B41J 3/4078; B65H 16/06; B65H 35/02; B65H 2301/412; B65H 2301/41487; B65H 2801/03

See application file for complete search history.

(56) References Cited

U.S. PATENT DOCUMENTS 5,826,474 A * 10/1998 Howard ..... B65H 35/06 83/423
2021/0179376 A1* 6/2021 Tomatsu ..... B65H 16/103

FOREIGN PATENT DOCUMENTS

JP 06-128875 * 5/1994 ..... B26D 5/34
JP H06-128875 5/1994

* cited by examiner

*Primary Examiner* — Henok D Legesse
(74) *Attorney, Agent, or Firm* — WORKMAN NYDEGGER

(57) ABSTRACT

A printing apparatus includes a feed shaft configured to feed a medium in a roll form by supporting and rotating the medium, a conveyance unit including a driving roller, a driven roller and an endless conveyance belt and configured to convey, in a conveyance direction, the medium supported by the conveyance belt by rotating the driving roller forward, a printing head configured to perform printing on the medium supported by the conveyance belt, and an ear portion winding shaft configured to wind up ear portions of the medium separated from the medium supported by the feed shaft.

11 Claims, 11 Drawing Sheets

PRINTING APPARATUS AND PRINTING METHOD

The present application is based on, and claims priority from JP Application Serial Number 2021-024179, filed Feb. 18, 2021, the disclosure of which is hereby incorporated by reference herein in its entirety.

BACKGROUND

1. Technical Field

The present disclosure relates to a printing apparatus and a printing method.

2. Related Art

In the related art, printing apparatuses of various configurations that can perform printing on a medium in a roll form have been used. Such printing apparatuses include a printing apparatus configured to perform printing on the medium while conveying the medium by using an endless conveyance belt stretched over a plurality of rollers. In a printing apparatus with such a configuration, an ear portion, which is an end portion of a medium in a roll form in the width direction, may possibly curl or the like on the conveyance belt and make contact with the printing head, thus causing a printing failure, a damage to printing head and/or the like. In view of this, as disclosed in JP-A-6-128875, there is a technique in which the ear portion of a medium in a roll form is separated before the medium in a roll form is set to printing apparatus, and then the medium is used, for example.

However, as disclosed in JP-A-6-128875, if a special apparatus for separating the ear portion of the medium in a roll form is prepared separately from a printing apparatus, the efficiency of the operation is low, the cost for preparing the special apparatus is required, and it is necessary to prepare the place for installing the special apparatus. In view of this, an object of the present disclosure is to separate an ear portion of a medium in a roll form without additionally preparing the special apparatus.

SUMMARY

A printing apparatus for solving the above-mentioned problems includes a conveyance unit including a feed shaft, a driving roller, a driven roller, and a conveyance belt having an endless form, the feed shaft being configured to feed a medium by supporting and rotating the medium in a rolled form, the driving roller being configured to rotate in forward and reverse directions, the conveyance belt being stretched over the driving roller and the driven roller and configured to support the medium fed from the feed shaft, the conveyance unit being configured to convey the medium supported by the conveyance belt in a conveyance direction by rotating the driving roller forward, a printing head configured to perform printing on the medium supported by the conveyance belt, and an ear portion winding shaft configured to wind up ear portions separated from the medium supported by the feed shaft, the ear portions being both end portions of the medium in a width direction orthogonal to the conveyance direction.

A printing method of a printing apparatus for solving the above-mentioned problems includes a conveyance unit including a feed shaft, a driving roller, a driven roller, and a conveyance belt having an endless form, the feed shaft being configured to feed a medium by supporting and rotating the medium in a rolled form, the driving roller being configured to rotate in forward and reverse directions, the conveyance belt being stretched over the driving roller and the driven roller and configured to support the medium fed from the feed shaft, the conveyance unit being configured to convey the medium supported by the conveyance belt in a conveyance direction by rotating the driving roller forward, a printing head configured to perform printing on the medium supported by the conveyance belt, and an ear portion winding shaft configured to wind up ear portions separated from the medium supported by the feed shaft, the ear portions being both end portions of the medium in a width direction orthogonal to the conveyance direction, the method including executing conveyance of the medium through rotation of the driving roller, feeding of the medium through rotation of the feed shaft, separation of the ear portion from a main body portion, and winding up of the ear portion through rotation of the ear portion winding shaft, when printing is performed with the printing head, by separating a part of the ear portion of the medium supported by the feed shaft from the main body portion in a state where a base end side of the ear portion is coupled with the main body portion, the main body portion being a portion other than the ear portion in the medium, and fixing a part on a top end side in the ear portion separated from the main body portion to the ear portion winding shaft, and supporting the main body portion at the conveyance belt.

DESCRIPTION OF EXEMPLARY EMBODIMENTS

Figure 1:
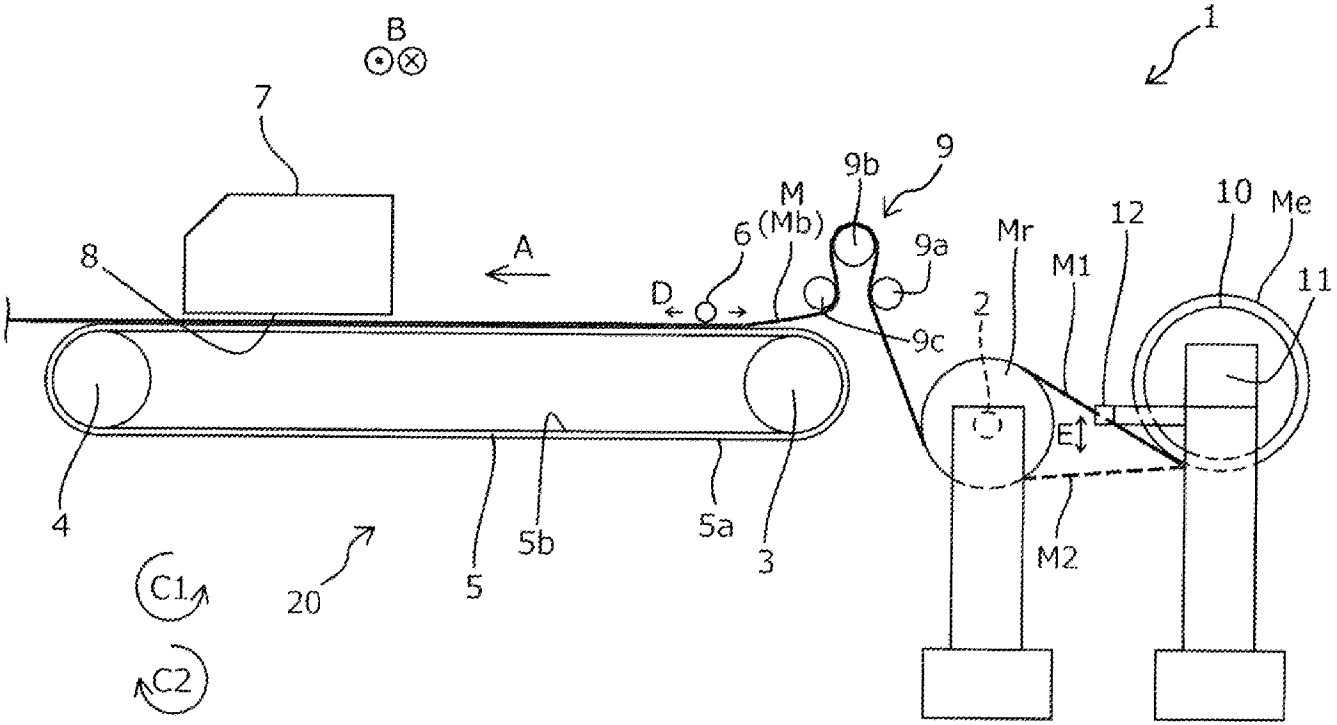
FIG. 1 is a schematic side view of a printing apparatus according to Example 1 of the present disclosure.

First, an overview the present disclosure is described.

A printing apparatus of a first aspect of the present disclosure for solving the above-mentioned problems includes a conveyance unit including a feed shaft, a driving roller, a driven roller, and a conveyance belt having an endless form, the feed shaft being configured to feed a medium by supporting and rotating the medium in a rolled form, the driving roller being configured to rotate in forward and reverse directions, the conveyance belt being stretched over the driving roller and the driven roller and configured to support the medium fed from the feed shaft, the conveyance unit being configured to convey the medium supported by the conveyance belt in a conveyance direction by rotating the driving roller forward, a printing head configured to perform printing on the medium supported by the conveyance belt, and an ear portion winding shaft configured to wind up ear portions separated from the medium supported by the feed shaft, the ear portions being both end portions of the medium in a width direction orthogonal to the conveyance direction.

According to the present aspect, the ear portion winding shaft that winds up the ear portion separated from the medium supported by the feed shaft is provided. Thus, the ear portion of the medium in a roll form can be separated and printing can be performed on the medium from which the ear portion is separated, without additionally preparing a special apparatus.

In the printing apparatus of a second aspect in the first aspect, the ear portion winding shaft is disposed at a position on a side opposite to the conveyance unit with respect to the feed shaft in the conveyance direction.

According to the present aspect, the ear portion winding shaft is disposed at a position on the side opposite to the conveyance unit with respect to the feed shaft in the conveyance direction. Thus, the ear portion that is separated is readily collected.

The printing apparatus of a third aspect in the first or second aspect further includes a motor configured to rotate the ear portion winding shaft, and a medium detection sensor configured to detect the medium. The medium detection sensor detects the medium at a predetermined height at a position between the ear portion winding shaft and the feed shaft in the conveyance direction, and the motor switches between rotation and stop of the ear portion winding shaft in accordance with a switching timing between detection and non-detection of the medium by the medium detection sensor.

According to the present aspect, the medium detection sensor detects the medium at a predetermined height at a position between the ear portion winding shaft and the feed shaft in the conveyance direction, and the motor switches between the rotation and stop of the ear portion winding shaft in accordance with the switching timing between detection and non-detection of the medium at the medium detection sensor. Thus, the ear portion can be favorably wound up, and the occurrence of a winding failure of the ear portion due to an excessively small rotation amount of the ear portion winding shaft, the occurrence of a feeding failure of the medium due to an excessively small rotation amount of the ear portion winding shaft at the feed shaft, and the like can be suppressed.

The printing apparatus of a fourth aspect in the first or second aspect further includes a motor configured to rotate the ear portion winding shaft, a winding diameter detection sensor configured to detect a winding diameter of the ear portion wound by the ear portion winding shaft, and a roll diameter detection sensor configured to detect a roll diameter of the medium supported by the feed shaft. The motor is configured to control rotation of the ear portion winding shaft such that a height of the ear portion in the vertical direction is maintained at a predetermined height at a position between the ear portion winding shaft and the feed shaft in the conveyance direction, based on the winding diameter detected by the winding diameter detection sensor and the roll diameter detected by the roll diameter detection sensor.

According to the present aspect, the motor can control the rotation of the ear portion winding shaft on the basis of the winding diameter detected by the winding diameter detection sensor and the roll diameter detected by the roll diameter detection sensor. Thus, the ear portion can be favorably wound up, and the occurrence of a winding failure of the ear portion due to an excessively small rotation amount of the ear portion winding shaft, the occurrence of a feeding failure of the medium due to an excessively small rotation amount of the ear portion winding shaft at the feed shaft, and the like can be suppressed.

The printing apparatus of a fifth aspect in the first or second aspect further includes a motor configured to rotate the ear portion winding shaft, a winding diameter detection sensor configured to detect a winding diameter of the ear portion wound by the ear portion winding shaft, and a calculation unit configured to calculate a rotational speed of the driving roller. The motor is configured to control rotation of the ear portion winding shaft such that a height of the ear portion in the vertical direction is maintained at a predetermined height at a position between the ear portion winding shaft and the feed shaft in the conveyance direction, based on the winding diameter detected by the winding diameter detection sensor and a rotational speed of the driving roller calculated by the calculation unit.

According to the present aspect, the motor can control the rotation of the ear portion winding shaft on the basis of the winding diameter detected by the winding diameter detection sensor and the rotational speed of the driving roller calculated by the calculation unit. Thus, the ear portion can be favorably wound up, and the occurrence of a winding failure of the ear portion due to an excessively small rotation amount of the ear portion winding shaft, the occurrence of a feeding failure of the medium due to an excessively small rotation amount of the ear portion winding shaft at the feed shaft, and the like can be suppressed.

The printing apparatus of a sixth aspect in any one of the first to fifth aspects further includes, as the ear portion winding shaft, a first ear portion winding shaft configured to wind up a first ear portion and a second ear portion winding shaft configured to wind up a second ear portion, the first ear portion being an end portion of the medium on one side in the width direction, the second ear portion being an end portion of the medium on another side in the width direction. A position of at least one of the first ear portion winding shaft and the second ear portion winding shaft is changeable in accordance with a width of the medium, the width being a length in a direction that intersects the conveyance direction.

According to the present aspect, the first ear portion winding shaft and the second ear portion winding shaft are provided as the ear portion winding shaft, and the position of at least one of the first ear portion winding shaft and the second ear portion winding shaft can be changed in accordance with the width of the medium. That is, while when the width of the medium changes, the position of the ear portion in the width direction of the medium also changes, the ear portion winding shaft can be disposed at a proper position in accordance with the width of the medium. Therefore, the ear portion can be wound up at a proper position, and the winding failure of the ear portion can be suppressed.

In the printing apparatus of a seventh aspect in the first aspect, the ear portion winding shaft is disposed at a position between the feed shaft and the conveyance unit in the conveyance direction.

According to the present aspect, the ear portion winding shaft is disposed at a position between the feed shaft and the conveyance unit in the conveyance direction. Thus, the medium in a roll form can be readily set to the feed shaft.

In the printing apparatus of an eighth aspect in the seventh aspect, the medium is disposed in a slack state between the feed shaft and the conveyance unit in the conveyance direction, and the ear portion winding shaft is placed on the medium.

According to the present aspect, the medium is disposed in a slack state between the feed shaft and the conveyance unit in the conveyance direction, and the ear portion winding shaft is placed on the medium. Thus, the device configuration can be simplified.

The printing apparatus of a ninth aspect in the seventh or eighth aspect further includes a guide rail configured to movably support the ear portion winding shaft.

According to the present aspect, the guide rail that movably supports the ear portion winding shaft is provided. Thus, the occurrence of a cutting failure of the ear portion due to the ear portion winding shaft disposed at a position deviated from a desired position and the like can be suppressed.

In the printing apparatus of a tenth aspect in any one of the first to ninth aspects further includes a blade part configured to slit a boundary portion between the ear portion and a main body portion other than the ear portion in the medium supported by the feed shaft.

According to the present aspect, the blade part that slits a boundary portion between the main body portion and the ear portion of the medium supported by the feed shaft is provided. Thus, the ear portion and the main body portion can be favorably separated.

A printing method of a printing apparatus of an eleventh aspect includes a conveyance unit including a feed shaft, a driving roller, a driven roller, and a conveyance belt having an endless form, the feed shaft being configured to feed a medium by supporting and rotating the medium in a rolled form, the driving roller being configured to rotate in forward and reverse directions, the conveyance belt being stretched over the driving roller and the driven roller and configured to support the medium fed from the feed shaft, the conveyance unit being configured to convey the medium supported by the conveyance belt in a conveyance direction by rotating the driving roller forward, a printing head configured to perform printing on the medium supported by the conveyance belt, and an ear portion winding shaft configured to wind up ear portions separated from the medium supported by the feed shaft, the ear portions being both end portions of the medium in a width direction orthogonal to the conveyance direction, the method including executing conveyance of the medium through rotation of the driving roller, feeding of the medium through rotation of the feed shaft, separation of the ear portion from a main body portion, and winding up of the ear portion through rotation of the ear portion winding shaft, when printing is performed with the printing head, by separating a part of the ear portion of the medium supported by the feed shaft from the main body portion in a state where a base end side of the ear portion is coupled with the main body portion, the main body portion being a portion other than the ear portion in the medium, and fixing a part on a top end side in the ear portion separated from the main body portion to the ear portion winding shaft, and supporting the main body portion at the conveyance belt.

According to the present aspect, printing can be performed while winding up the ear portion separated from the medium supported by the feed shaft, by the ear portion winding shaft. Thus, the ear portion of the medium in a roll form can be separated and printing can be performed on the medium from which the ear portion is separated, without additionally preparing a special apparatus.

Example 1

Embodiments according to the present disclosure are described below with reference to the accompanying drawings. First, an overview of a printing apparatus 1 according to Example 1 of the present disclosure is described with reference to FIG. 1 to FIG. 3.

As illustrated in FIG. 1 and the like, the printing apparatus 1 of this example includes a conveyance belt 5 that can convey a medium M in a conveyance direction A by rotating in a rotational direction C1. In addition, it is provided with a feed shaft 2 that can feed the medium M by rotating in the state where a roll Mr of the medium M in a rolled form is set. The conveyance belt 5 has a configuration that can convey, in the conveyance direction A, the medium M fed from the feed shaft 2 through a roller group 9 composed of a driven roller 9*a*, a brake roller 9*b* and a driven roller 9*c*. The conveyance belt 5 is an endless belt stretched over a driven roller 3 located upstream in the conveyance direction A and a driving roller 4 located downstream in the conveyance direction A. The conveyance belt 5 is stretched over the driving roller 4 and the driven roller 3 disposed in contact with an inner surface 5*b* of the conveyance belt 5, and the conveyance belt 5, the driving roller 4 and the driven roller 3 make up a conveyance unit 20. Note that the roller group 9, the feed shaft 2, an ear portion winding shaft 10 described later and the like may also be regarded as components of the conveyance unit 20. The driving roller 4 can rotate in the rotational direction C1 and a rotational direction C2 with a driving force of a motor not illustrated in the drawing. When the driving roller 4 is rotated in the rotational direction C1, the conveyance belt 5 also rotates in the rotational direction C1, and when the driving roller 4 is rotated in the rotational direction C2, the conveyance belt 5 also rotates in the rotational direction C2. Note that in the case where the rotational direction of conveying the medium M in the conveyance direction A is set as the forward rotation and the rotational direction of conveying the medium M in the direction opposite to the conveyance direction A is set as the reverse direction, the rotational direction C1 corresponds to the forward direction of the driving roller 4, the conveyance belt 5 and the driven roller 3, and the rotational direction C2 corresponds to corresponds to the reverse direction of the driving roller 4, the conveyance belt 5 and the driven roller 3.

Here, the conveyance belt 5 is an adhesive belt with adhesive applied to a support surface 5*a*, which is an outer surface. As illustrated in FIG. 1, the medium M is supported and conveyed by the conveyance belt 5 in the state where the medium M is bonded to the support surface 5*a* on which adhesive is applied. The support region for the medium M in the conveyance belt 5 is an upper region stretched over the driven roller 3 and the driving roller 4. In addition, the driving roller 4 is a roller that rotates with a driving force of a motor not illustrated in the drawing as described above, and the driven roller 3 is a roller that rotates to follow the rotation of the conveyance belt 5 along with the rotation of the driving roller 4.

The medium M fed from the feed shaft 2 to the conveyance belt 5 through the roller group 9 is pressed by a press roller 6 and bonded to the support surface 5*a*. The press roller 6 is extended in a width direction B, which intersects the conveyance direction A, and the press roller 6 can move in a movement direction D, which is along the conveyance direction A. By moving the medium M in the movement direction D while pressing the medium M toward the conveyance belt 5 by the press roller 6, the medium M can be reliably bonded to the support surface 5*a*. The press roller 6 presses the medium M against the conveyance belt 5 over the width direction B, and thus the medium M is bonded to the conveyance belt 5 in the state where generation of wrinkles and the like is suppressed.

In addition, the printing apparatus 1 includes a carriage 7 that is movable back and forth in the width direction B, and a printing head 8 attached to the carriage 7. The printing head 8 is a so-called ink-jet head that discharges ink to the medium M being conveyed in the conveyance direction A. In a region facing the printing head 8, ink is discharged to the medium M supported by the conveyance belt 5, and an image is formed on the medium M.

In this manner, the printing apparatus 1 of this example can form an image by discharging ink from the printing head 8 to the medium M being conveyed while moving back and forth the carriage 7 in the width direction B that intersects the conveyance direction A. With the carriage 7 having such a configuration, the printing apparatus 1 of this example forms a desired image on the medium M by repeating conveyance of the medium M in the conveyance direction A by a predetermined conveyance amount, and discharge of ink while moving the carriage 7 in the width direction B with the medium M being stopped.

Note that the printing apparatus 1 of this example is a so-called serial printer that performs printing by alternately repeating a conveyance of the medium M by a predetermined amount and a back and forth movement of the carriage 7, but may be a so-called line printer that successively performs printing by successively conveying the medium M by using a line head in which a nozzle is formed in a line along the width direction B of the medium M. Furthermore, it is also possible to adopt a configuration provided with printing heads other than ink-jet printing heads, such as thermal transfer printing heads.

When the medium M on which an image is formed is ejected from the printing apparatus 1 of this example, the medium M is fed to a drying apparatus that volatilizes the ink component discharged to the medium M, a winding apparatus that winds up the medium M on which an image is formed, and the like, which are provided at a succeeding stage of the printing apparatus 1 of this example.

Note that the printing apparatus 1 of this example has a configuration that can separate the medium M in a rolled form into an ear portion Me, which is both end portions in the width direction B, and a main body portion Mb other than the ear portion Me, can perform printing on the main body portion Mb, and can wind up the ear portion Me. Specifically, as described above, the conveyance unit 20 disposed downstream of the feed shaft 2 in the conveyance direction A and the ear portion winding shaft 10 disposed upstream of the feed shaft 2 in the conveyance direction A and configured to wind up the ear portion Me are provided. The following describes a printing method of performing printing while winding up the ear portion Me by using the printing apparatus 1 of this example and a configuration of the ear portion winding shaft 10.

Here, in the printing apparatus 1 of this example, a material for textile printing may be preferably used as the medium M. The material for textile printing refers to fabrics, clothes, or other clothing products to be printed. The fabrics include woven, knitted, and nonwoven fabrics made of natural fibers such as cotton, silk, and wool, chemical fibers such as nylon, and composite fibers of mixtures of them. In addition, clothing and other clothing products include post-sewn T-shirts, handkerchiefs, scarves, towels, handbags, cloth bags, curtains, sheets, bedspreads and other furniture, as well as fabrics and the like before and after cutting that exist as parts in a pre-sewn state.

The roll Mr composed of the material for textile printing easily causes deformation, fluffing and the like at the ear portion Me during transportation and the like. As such, if printing is performed with deformation, fluffing or the like caused at the ear portion Me, the ear portion Me and the printing head 8 may possibly make contact with each other, resulting in printing failure, a damage to the printing head 8 and the like. In view of this, the printing apparatus 1 of this example is configured to separate the ear portion Me and perform printing on the main body portion Mb from which the ear portion Me is removed.

It should be noted that the printing apparatus 1 of this example may use not only the above-mentioned material for textile printing, but also special paper for ink-jet printing paper such as plain paper, high quality paper and gloss paper, as the medium M. In addition, as the medium M, for example, a plastic film in which the surface is not processed for ink-jet printing, i.e., no ink absorption layer is formed, one provided with a plastic coating on a base material such as paper, and one provided with a plastic film bonded thereto. The plastic is not limited, but examples of the plastic include polyvinyl chloride, polyethylene terephthalate, polycarbonate, polystyrene, polyurethane, polyethylene, and polypropylene. When it is not necessary to separate the ear portion Me such as when using the above-mentioned medium, the printing apparatus 1 of this example may perform printing without separating the ear portion Me without using the ear portion winding shaft 10.

Figure 2:
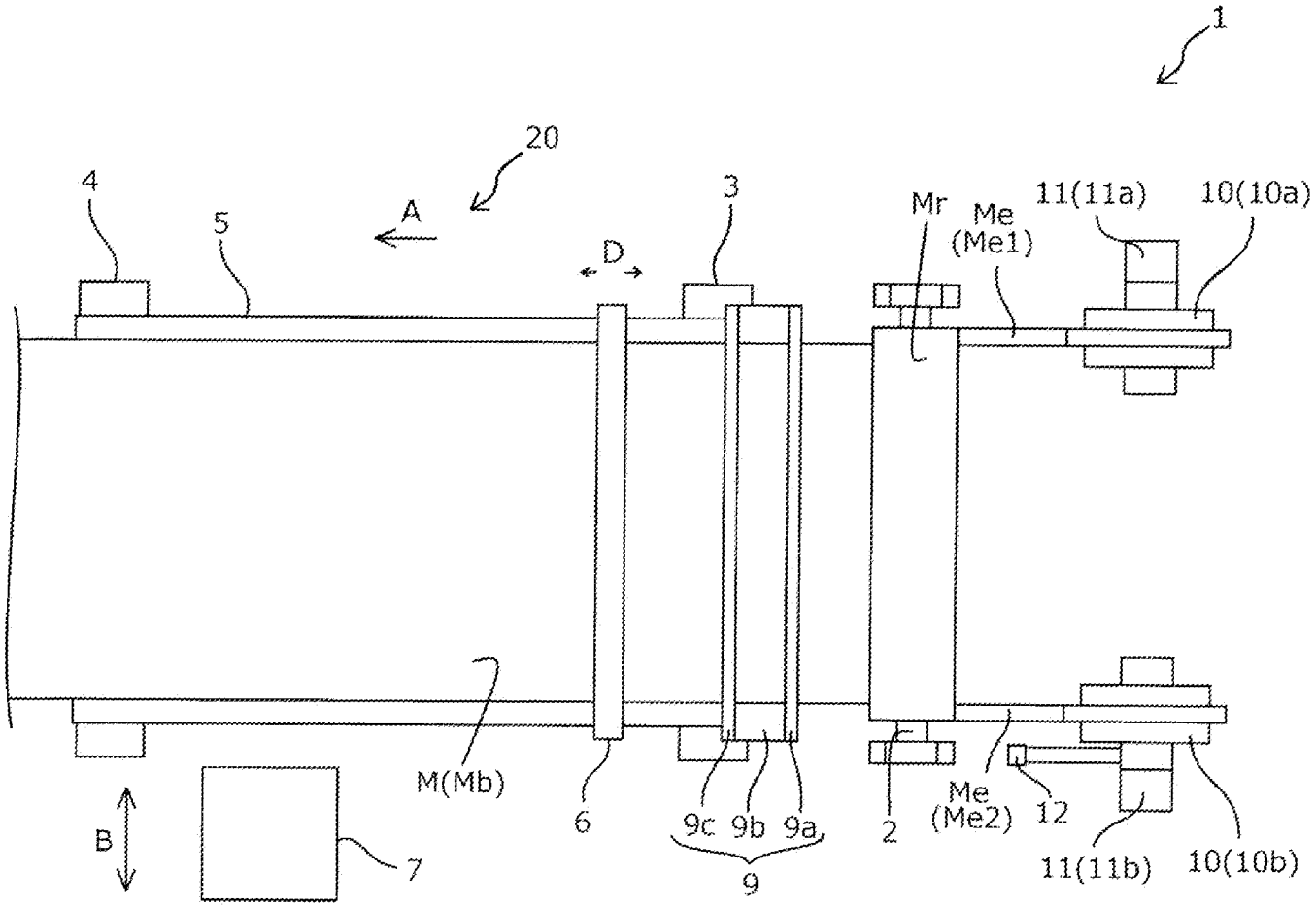
FIG. 2 is a schematic plan view of the printing apparatus according to Example 1 of the present disclosure.
Figure 3:
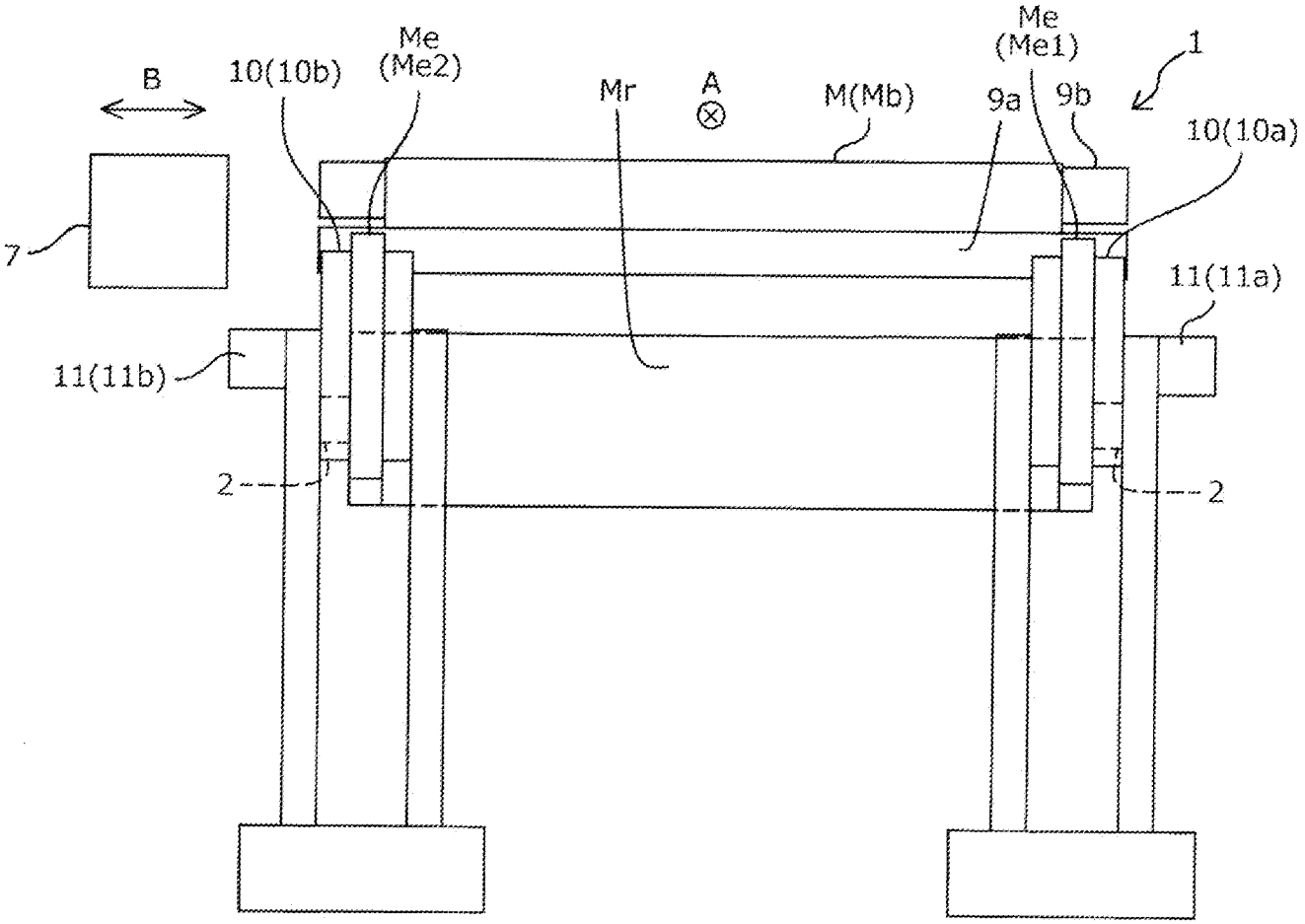
FIG. 3 is a schematic rear view of the printing apparatus according to Example 1 of the present disclosure.

As illustrated in FIG. 2 and FIG. 3, the printing apparatus 1 of this example includes, as the ear portion winding shaft 10, a first ear portion winding shaft 10*a* and a second ear portion winding shaft 10*b*. For the ear portion Me, which is located at both end portions in the width direction B, the first ear portion winding shaft 10*a* winds up a first ear portion Me1 located at one end portion in the width direction B, and the second ear portion winding shaft 10*b* winds up a second ear portion Me2 located on the other end portion in the width direction B. Note that as a motor 11 that rotates the ear portion winding shaft 10, a first motor 11*a* that rotates the first ear portion winding shaft 10*a* and a second motor 11*b* that rotates the second ear portion winding shaft 10*b* are provided.

In the case where printing is performed while winding up the ear portion Me by using the printing apparatus 1 of this example, the operator tears the ear portion Me from the medium M set at the feed shaft 2 and bonds the top end of the ear portion Me to the ear portion winding shaft 10, before performing the printing. Note that the material for textile printing can be easily torn straight along the texture of the fabric in the direction along the conveyance direction A. FIG. 1 to FIG. 3 illustrate a state where the ear portion Me is torn from the medium M set at the feed shaft 2, and the top end of the ear portion Me is bonded to the ear portion winding shaft 10. In the state where the state illustrated in FIG. 1 to FIG. 3 is set, when printing is performed, the feed shaft 2 rotates, the medium M is separated from the roll Mr into the main body portion Mb and the ear portion Me, and the main body portion Mb and the ear portion Me are ejected from the feed shaft 2 in opposite directions in the conveyance direction A such that only the main body portion Mb is fed to the conveyance belt 5 and that the ear portion Me is wound by the ear portion winding shaft 10.

In addition, as illustrated in FIG. 1 and FIG. 2, the printing apparatus 1 of this example includes a medium detection sensor 12 that detects the medium M. The medium detection sensor 12 is disposed at a predetermined height in the vertical direction. The motor 11 drives to wind up the ear portion Me around the ear portion winding shaft 10 in the state where the medium M is not detected by the medium detection sensor 12, and the motor 11 stops when the medium M is detected by the medium detection sensor 12. In the above-described manner, the printing apparatus 1 of this example performs intermittent conveyance of repeating the conveyance and stop of the medium M during the printing, and, along with a single conveyance of the medium M in the intermittent conveyance, the ear portion Me moves from a position M1 to a position M2 in FIG. 1, for example. The medium detection sensor 12 is disposed to detect the medium M when the ear portion Me is located at the position M1. Specifically, when the ear portion Me comes to the position M1, the motor 11 stops and the ear portion Me stays at the position M1. Then, when the ear portion Me moves from the position M1 to the position M2 along with the single conveyance of the medium M in the next intermittent conveyance, the ear portion Me moves out from the detection position of the medium detection sensor 12, the medium detection sensor 12 stops detecting the medium M, and thus the motor 11 drives. Then, when the ear portion Me is wound around the ear portion winding shaft 10 along with the drive of the motor 11, the ear portion Me moves from the position M2 toward the position M1. With such a configuration, the printing apparatus 1 of this example repeats such an operation during the printing, and the ear portion Me moves back and forth in a vertical direction E between the position M1 and the position M2.

Here, in brief, the printing apparatus 1 of this example includes the feed shaft 2 that feeds the medium M in a rolled form by supporting and rotating the medium M. In addition, it includes the driving roller 4 that can rotate in forward and reverse directions, the driven roller 3, the endless conveyance belt 5 stretched over the driving roller 4 and the driven roller 3 and configured to support the medium fed from the feed shaft 2, and the conveyance unit 20 that conveys the medium M supported by the conveyance belt 5 in the conveyance direction A by rotating the driving roller 4 forward. In addition, it includes the printing head 8 that performs printing on the medium M supported by the conveyance belt 5. Further, it includes the ear portion winding shaft 10 that winds up the ear portion Me, which is the both end portions of the medium M in the width direction B that are separated from of the medium M supported by the feed shaft 2. In this manner, with the ear portion winding shaft 10 that winds up the ear portion Me separated from the medium M supported by the feed shaft 2, the printing apparatus 1 of this example can perform printing on the medium M from which the ear portion Me is separated by cutting off the ear portion Me of the medium M of a roll form, without additionally providing a special apparatus.

In addition, as a printing method using the printing apparatus 1 of this example, the following procedure can be executed. First, as illustrated in FIG. 1 and FIG. 2, from the main body portion Mb, which is a portion other than the ear portion Me in the medium M, the operator separates a part of the ear portion Me in the medium M supported by the feed shaft 2, with the base end side coupled with the main body portion Mb. Then, a part of the ear portion Me on the top end side separated from the main body portion Mb is fixed to the ear portion winding shaft 10 by using an adhesive tape, for example, and the main body portion Mb is supported by the conveyance belt 5. Thereafter, printing is performed using the printing head 8, and during the printing, conveyance of the medium M through the rotation of the driving roller 4, feeding of the medium M through the rotation of the feed shaft 2, separation of the ear portion Me from the main body portion Mb, and winding of the ear portion Me through the rotation of the ear portion winding shaft 10 are executed in combination and repeated. By executing such a printing method, it is possible to perform printing on the medium M from which the ear portion Me is separated by separating the ear portion Me of the medium M of a roll form, without additionally providing a special apparatus.

In addition, as illustrated in FIG. 1 and FIG. 2, in the printing apparatus 1 of this example, the ear portion winding shaft 10 is disposed at a position on the side opposite to the conveyance unit 20 with respect to the feed shaft 2 in the conveyance direction A. That is, in the printing apparatus 1 of this example, the ear portion winding shaft 10 is disposed on the most upstream side in the conveyance direction A in the printing apparatus 1. Thus, the ear portion Me that is separated can be collected from the most upstream side in the conveyance direction A in the printing apparatus 1. Thus, the printing apparatus 1 of this example can readily collect the ear portion Me that is separated.

In addition, as described above, the printing apparatus 1 of this example includes the motor 11 that rotates the ear portion winding shaft 10 and the medium detection sensor 12 that detects the medium M. Further, as illustrated in FIG. 1 and FIG. 2, the medium detection sensor 12 is configured to detect the medium M at a predetermined height at a position between the ear portion winding shaft 10 and the feed shaft 2 in the conveyance direction A. Here, as described above, the motor 11 drives in the state where the medium M is not detected by the medium detection sensor 12, and stops the detection of when the medium M is detected by the medium detection sensor 12. That is, the motor 11 switches between the rotation and stop of the ear portion winding shaft 10 in accordance with the switching timing between the detection and non-detection of the medium M at the medium detection sensor 12. With such a configuration, the printing apparatus 1 of this example can favorably wind up the ear portion Me, and can suppress the occurrence of a winding failure of the ear portion Me due to an excessively small rotation amount of the ear portion winding shaft 10, the occurrence of a feeding failure of the medium M at the feed shaft 2 due to an excessively small rotation amount of the ear portion winding shaft 10 and the like. Note that it is possible to adopt a configuration in which it is not stopped even when the medium M is detected by the medium detection sensor 12, but it is desirable to adopt the configuration of this example in order to suppress overheating of the motor 11 and shredding of the ear portion Me due to excessive pulling.

Note that in the printing apparatus 1 of this example, when the medium M is conveyed in the conveyance direction A along with the printing, the feed shaft 2 rotates in the rotational direction C2 and the ear portion winding shaft 10 rotates in the rotational direction C1. In view of this, the roll Mr is set to the feed shaft 2 and a part of the ear portion Me on the top end side is bonded to the ear portion winding shaft 10 so as to set the arrangement illustrated in FIG. 1. Then, the ear portion Me moves downward from the position M1 to the position M2 along with the rotation of the feed shaft 2 in the rotational direction C2 along with the intermittent conveyance of the medium M, and the ear portion Me moves upward from the position M2 to the position M1 along with the rotation of the ear portion winding shaft 10 in the rotational direction C1. It should be noted that such a configuration is not limitative. For example, the movement direction of the ear portion Me may be changed to the upside-down direction from this example by changing the rotational direction of the feed shaft 2 and/or the ear portion winding shaft 10, and changing the arrangement of the roll Mr and/or the bonding position of the top end of the ear portion Me to the ear portion winding shaft 10 and the like. Further, it is also possible to adopt a configuration in which along with the change in the movement direction of the ear portion Me and the like, the motor 11 stops in the state where the medium M is not detected by the medium detection sensor 12, and the motor 11 drives when the medium M is detected by the medium detection sensor 12.

Example 2

Figure 4:
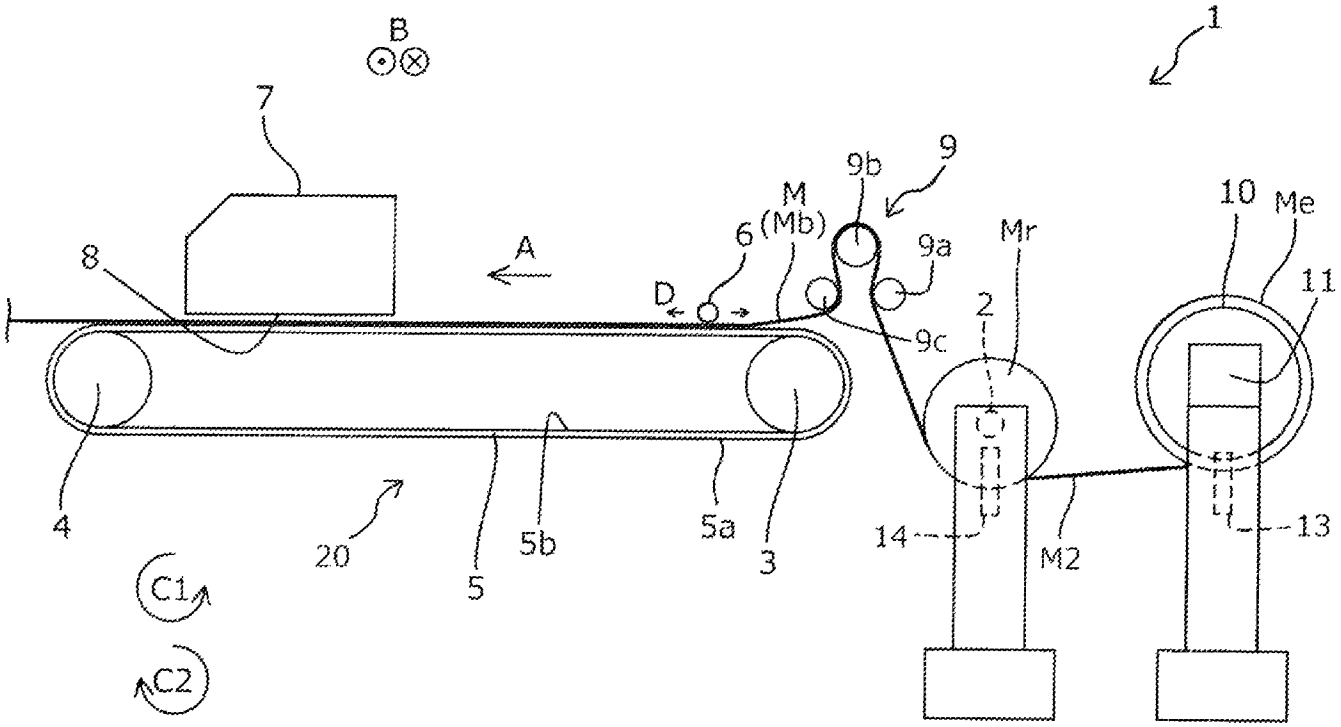
FIG. 4 is a schematic side view of a printing apparatus according to Example 2 of the present disclosure.

Next, the printing apparatus 1 of Example 2 is described with reference to FIG. 4. Note that FIG. 4 is a diagram corresponding to FIG. 1 of the printing apparatus 1 of Example 1. In FIG. 4, the same components as those of the above-described Example 1 are illustrated with the same reference symbols, and the description thereof is omitted. Here, the printing apparatus 1 of this example has the same configuration as that of the printing apparatus 1 of Example 1 except that a winding diameter detection sensor 13 and a roll diameter detection sensor 14 are provided in place of the medium detection sensor 12.

As illustrated in FIG. 4, the printing apparatus 1 of this example includes the motor 11 that rotates the ear portion winding shaft 10 as with the printing apparatus 1 of Example 1. In addition, it includes the winding diameter detection sensor 13 that detects the winding diameter of the ear portion Me wound by the ear portion winding shaft 10, and the roll diameter detection sensor 14 that detects the roll diameter of the roll Mr of the medium M supported by the feed shaft 2. In the printing apparatus 1 of this example, the motor 11 is configured to control the rotation of the ear portion winding shaft 10 so as to maintain a predetermined height of the ear portion Me in the vertical direction at a position between the ear portion winding shaft 10 and the feed shaft 2 in the conveyance direction A on the basis of the winding diameter detected by the winding diameter detection sensor 13 and the roll diameter detected by the roll diameter detection sensor 14. Here, the predetermined height is, for example, the height of the position M2 in FIG. 4. Thus, as with the printing apparatus 1 of Example 1, the printing apparatus 1 of this example has a configuration that can favorably wind up the ear portion Me, and can suppress the occurrence of a winding failure of the ear portion Me due to an excessively small rotation amount of the ear portion winding shaft 10, the occurrence of a feeding failure of the medium M at the feed shaft 2 due to an excessively small rotation amount of the ear portion winding shaft 10 and the like.

Example 3

Figure 5:
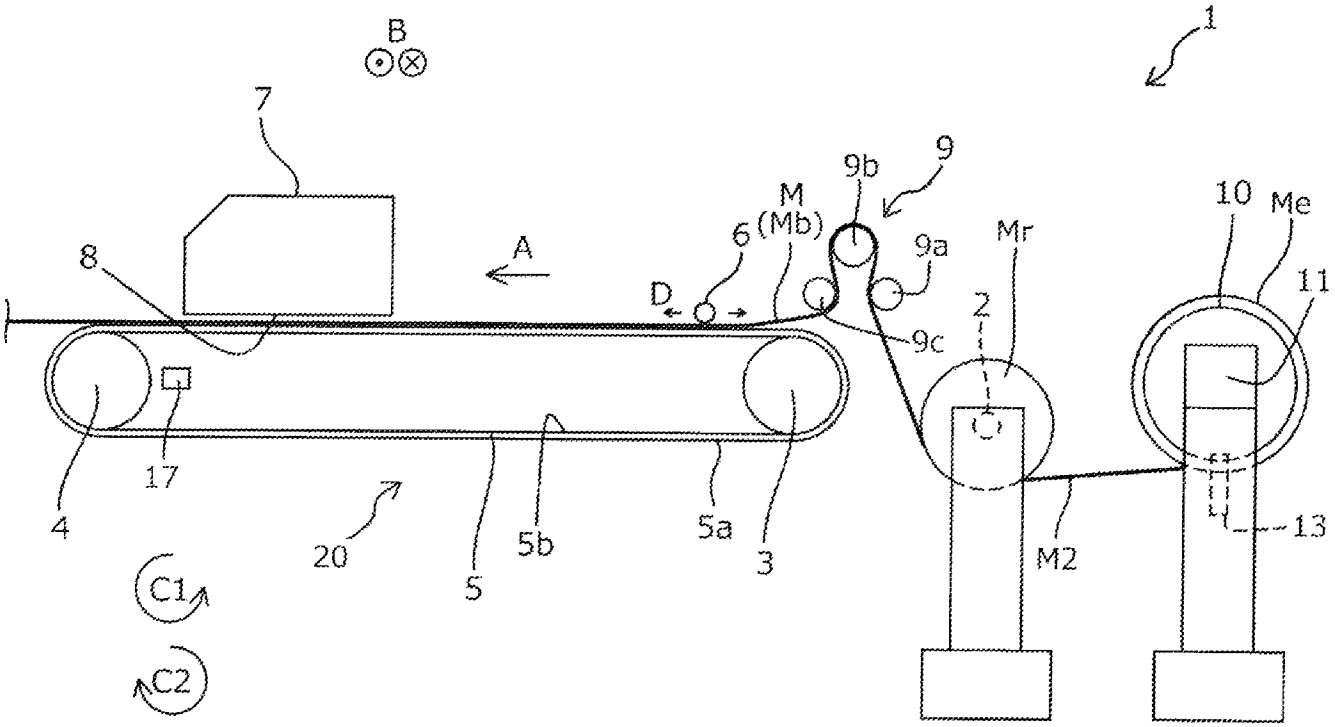
FIG. 5 is a schematic side view of a printing apparatus according to Example 3 of the present disclosure.

Next, the printing apparatus 1 of Example 3 is described with reference to FIG. 5. Note that FIG. 5 is a diagram corresponding to FIG. 1 of the printing apparatus 1 of Example 1. In FIG. 5, the same components as those of the above-described Example 1 and Example 2 are illustrated with the same reference symbols, and the description thereof is omitted. Here, the printing apparatus 1 of this example has the same configuration as that of the printing apparatus 1 of Example 2 except that a calculation unit 17 is provided in place of the roll diameter detection sensor 14.

As illustrated in FIG. 5, the printing apparatus 1 of this example includes the calculation unit 17 that calculates the rotational speed of the driving roller 4. Then, the motor 11 is configured to control the rotation of the ear portion winding shaft 10 so as to maintain a predetermined height of the ear portion Me in the vertical direction at a position between the ear portion winding shaft 10 and the feed shaft 2 in the conveyance direction A on the basis of the winding diameter detected by the winding diameter detection sensor 13 and the rotational speed of the driving roller 4 calculated by the calculation unit 17. Here, the predetermined height is, for example, the height of the position M2 in FIG. 5. Thus, as with the printing apparatus 1 of Example 1 and Example 2, the printing apparatus 1 of this example can favorably wind up the ear portion Me, and can suppress the occurrence of a winding failure of the ear portion Me due to an excessively small rotation amount of the ear portion winding shaft 10, the occurrence of a feeding failure of the medium M at the feed shaft 2 due to an excessively small rotation amount of the ear portion winding shaft 10 and the like. Note that the "rotational speed" indicates the amount of rotation in a predetermined time, and for example, a high rotational speed includes a case where the speed during rotation is high, a case where the stopped period during intermittent rotation is short, and the like.

Example 4

Figure 6:
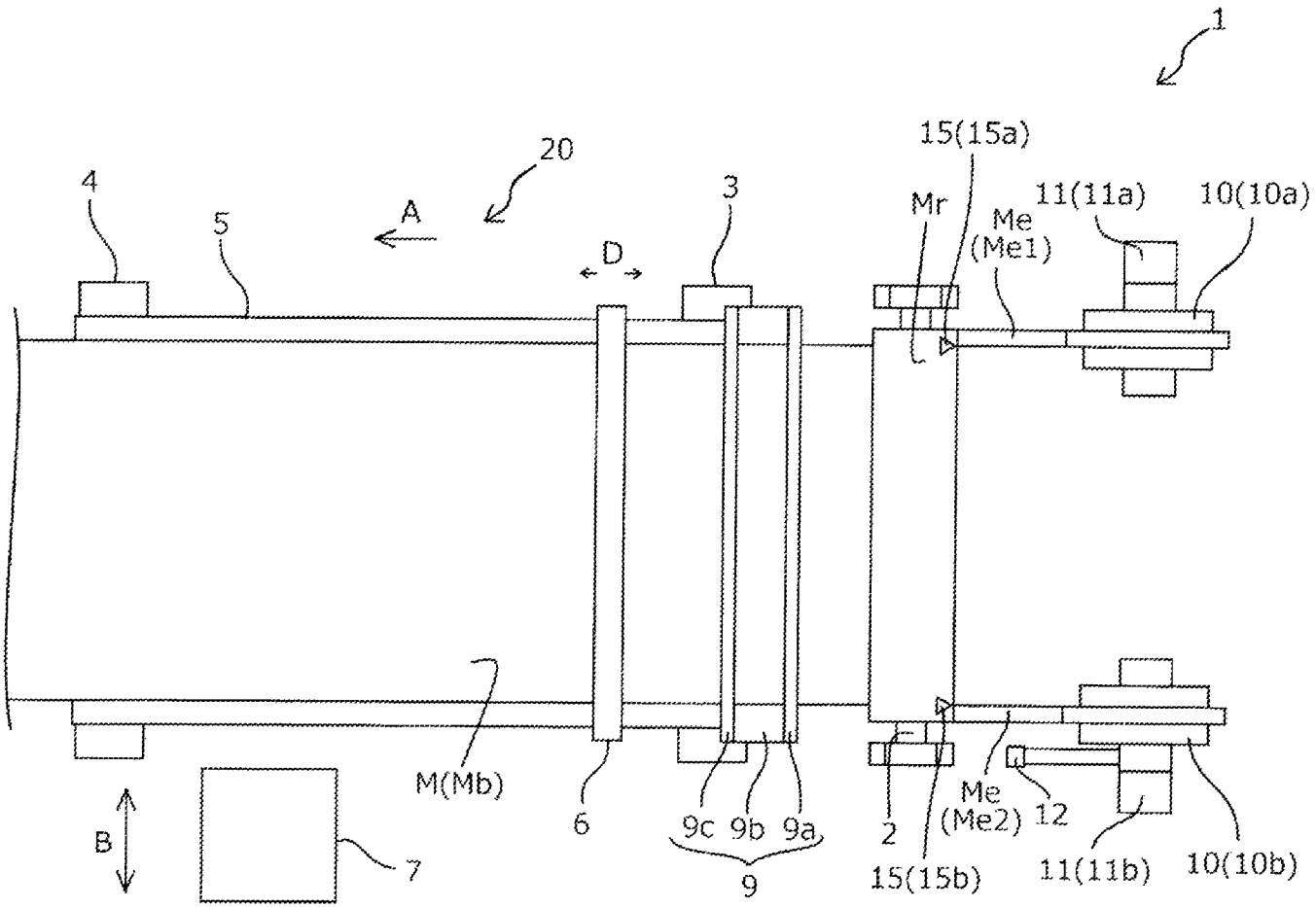
FIG. 6 is a schematic plan view of a printing apparatus according to Example 4 of the present disclosure.

Next, the printing apparatus 1 of Example 4 is described with reference to FIG. 6. Note that FIG. 6 is a diagram corresponding to FIG. 2 of the printing apparatus 1 of Example 1. In FIG. 6, the same components as those of the above-described Example 1 to Example 3 are illustrated with the same reference symbols, and the description thereof is omitted. Here, the printing apparatus 1 of this example has the same configuration as that of the printing apparatus 1 of Example 1 except that a blade part 15 that slits a boundary portion between the ear portion Me and the main body portion Mb is provided.

As illustrated in FIG. 6, the printing apparatus 1 of this example includes the blade part 15 that slits a boundary portion between the ear portion Me and the main body portion Mb at the medium M supported by the feed shaft 2. Specifically, it includes, as the blade part 15, a first blade part 15*a* that slits a boundary portion between the main body portion Mb and the first ear portion Me1, which is an end portion of the medium M on one side in the width direction B, and a second blade part 15*b* that slits a boundary portion between the main body portion Mb and the second ear portion Me2, which is an end portion of the medium M on the other side in the width direction B. In this manner, the printing apparatus 1 of this example can favorably separate the ear portion Me and the main body portion Mb.

Note that the printing apparatus 1 of Example 1 to Example 4 includes, as the ear portion winding shaft 10, the first ear portion winding shaft 10*a* that winds up the first ear portion Me1, which is an end portion of the medium M on one side in the width direction B, and the second ear portion winding shaft 10*b* that winds up the second ear portion Me2, which is an end portion of the medium M on the other side in the width direction B. Further, the positions of the first ear portion winding shaft 10*a* and the second ear portion winding shaft 10*b* can be changed in accordance with the width, which is the length in the direction that intersects the conveyance direction A, of the medium M to be used.

It is preferable to adopt a configuration in which the first ear portion winding shaft 10*a* and the second ear portion winding shaft 10*b* are provided as the ear portion winding shaft 10 such that the position of at least one of the first ear portion winding shaft 10*a* and the second ear portion winding shaft 10*b* can be changed in accordance with the width of the medium M as in the printing apparatus 1 of Example 1 to Example 4. The reason for this is that while when the width of the medium M to be used changes, the position of the ear portion Me of the medium M in the width direction B also changes, the ear portion Me can be wound up at a proper position and the winding failure of the ear portion Me can be suppressed since the ear portion winding shaft 10 can be disposed at a proper position in accordance with the width of the medium M. It should be noted that such a configuration is not limitative.

Example 5

Figure 7:
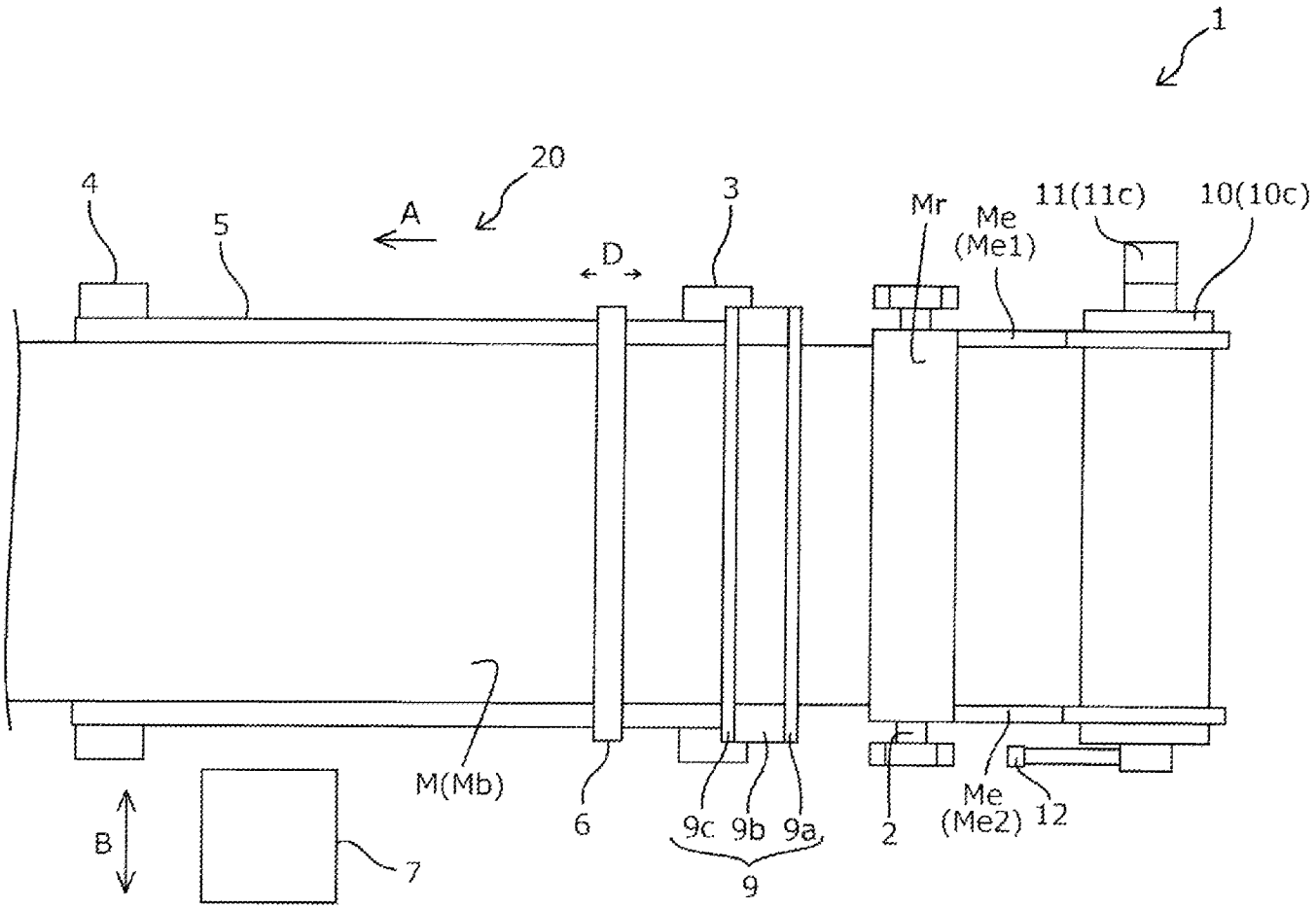
FIG. 7 is a schematic plan view of a printing apparatus according to Example 5 of the present disclosure.

Next, the printing apparatus 1 of Example 5 is described with reference to FIG. 7. Note that FIG. 7 is a diagram corresponding to FIG. 2 of the printing apparatus 1 of Example 1. In FIG. 7, the same components as those of the above-described Example 1 to Example 4 are illustrated with the same reference symbols, and the description thereof is omitted. Here, the printing apparatus 1 of this example has the same configuration as that of the printing apparatus 1 of Example 1 except that the ear portion winding shaft that winds up the first ear portion Me1 and the ear portion winding shaft that winds up the second ear portion Me2 are composed of one ear portion winding shaft 10*c*. As in this example, the ear portion winding shaft that winds up the first ear portion Me1 and the ear portion winding shaft that winds up the second ear portion Me2 may be composed of one ear portion winding shaft 10.

Example 6

Figure 8:
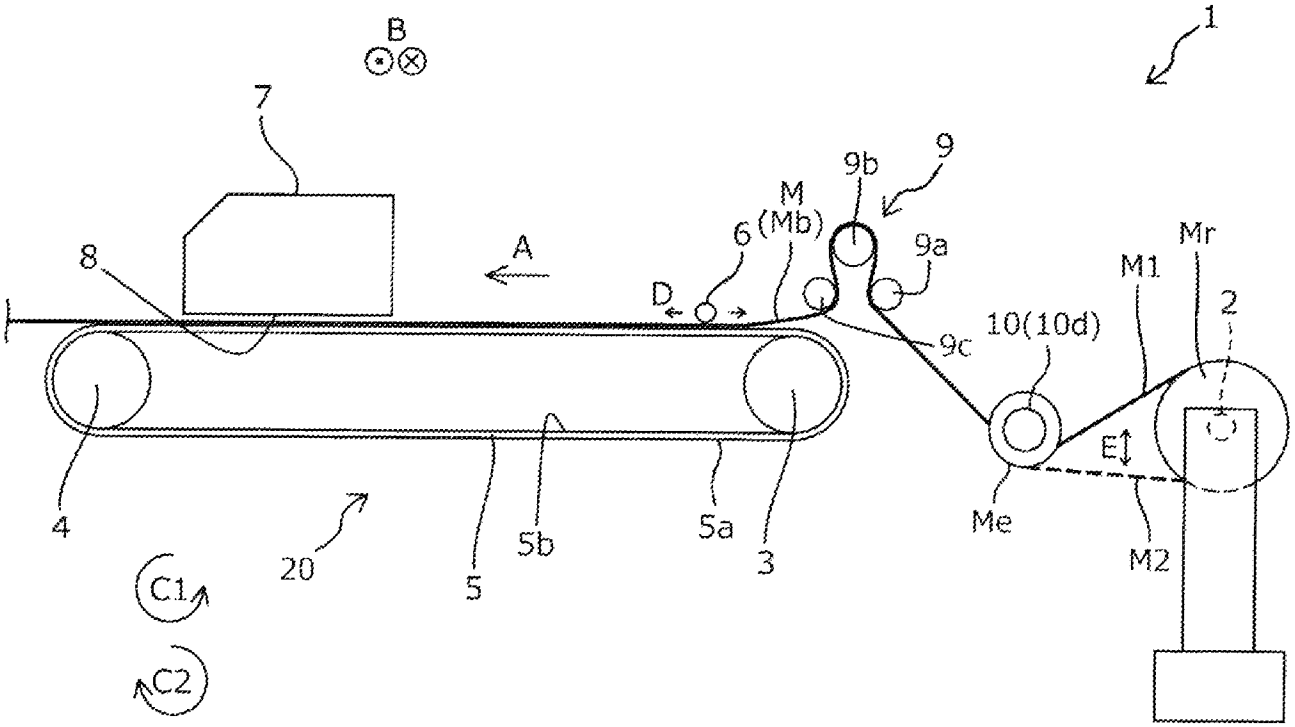
FIG. 8 is a schematic side view of a printing apparatus according to Example 6 of the present disclosure.
Figure 9:
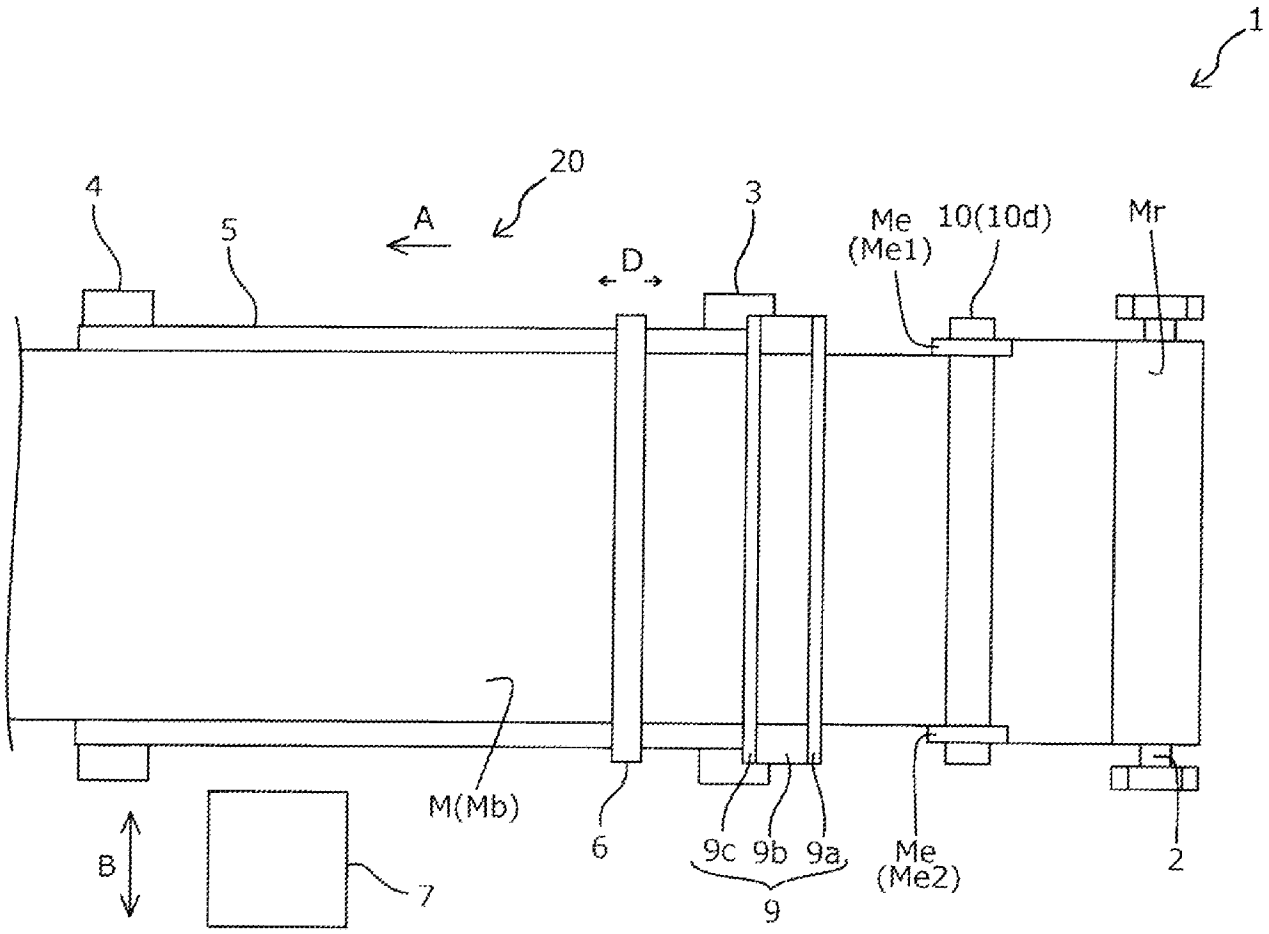
FIG. 9 is a schematic plan view of the printing apparatus according to Example 6 of the present disclosure.
Figure 10:
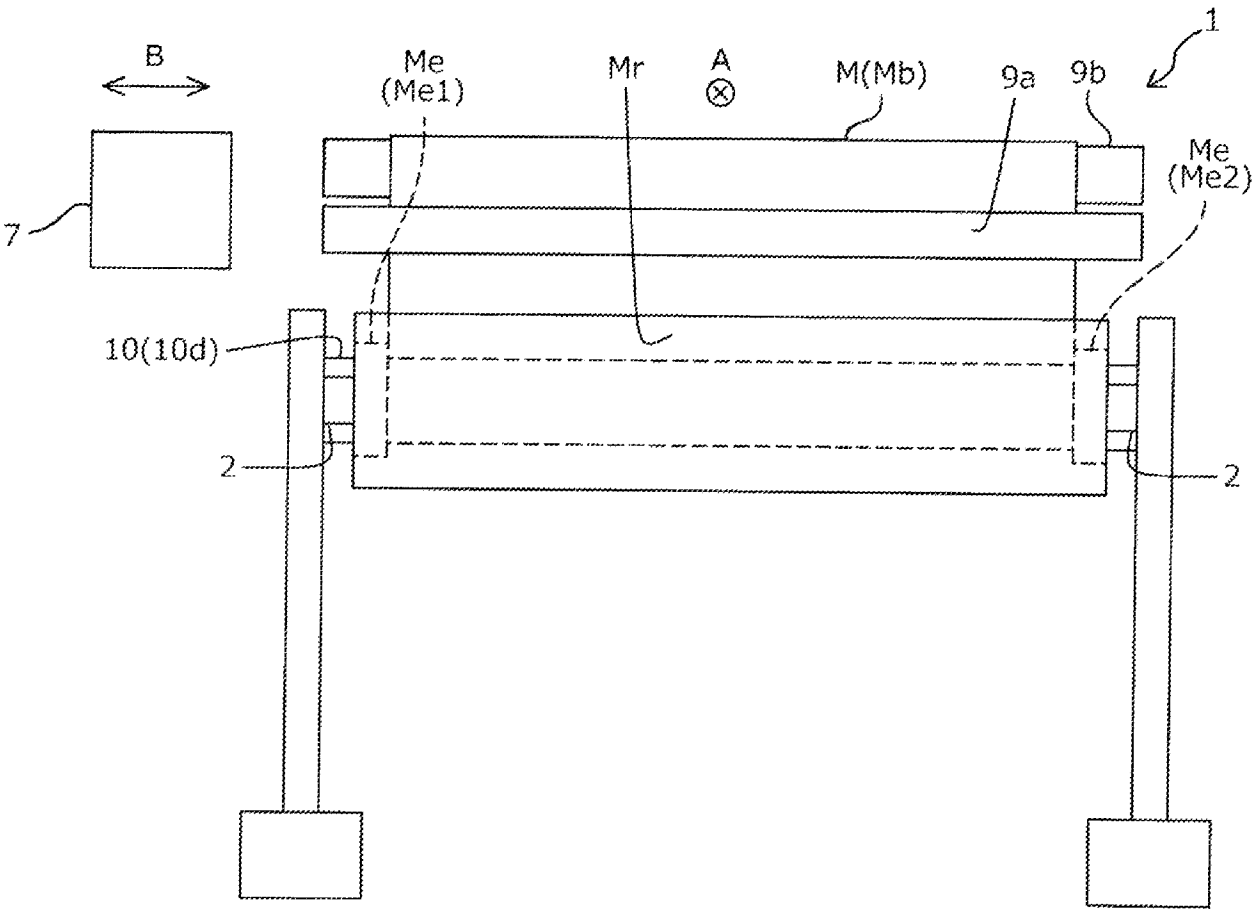
FIG. 10 is a schematic rear view of the printing apparatus according to Example 6 of the present disclosure.

Next, the printing apparatus 1 of Example 6 is described with reference to FIG. 8 to FIG. 10. Note that FIG. 8 is a diagram corresponding to FIG. 1 of the printing apparatus 1 of Example 1, FIG. 9 is a diagram corresponding to FIG. 2 of the printing apparatus 1 of Example 1, and FIG. 10 is a diagram corresponding to FIG. 3 of the printing apparatus 1 of Example 1. In FIG. 8 to FIG. 10, the same components as those of the above-described Example 1 to Example 5 are illustrated with the same reference symbols, and the description thereof is omitted.

As illustrated in FIG. 8 to FIG. 10, in the printing apparatus 1 of this example, one ear portion winding shaft 10*d* extended in the width direction B as the ear portion winding shaft 10 is disposed at a position between the feed shaft 2 and the conveyance unit 20 in the conveyance direction A. In other words, the feed shaft 2 is disposed on the most upstream side in the conveyance direction A in the printing apparatus 1. Thus, the roll Mr of the medium M can be set to the feed shaft 2 from the most upstream side in the conveyance direction A in the printing apparatus 1. Thus, the printing apparatus 1 of this example can readily set the roll Mr of the medium M to the feed shaft 2.

In addition, as illustrated in FIG. 8, in the printing apparatus 1 of this example, the medium M is disposed in a slack state between the feed shaft 2 and the conveyance unit 20 in the conveyance direction A, and the ear portion winding shaft 10 is placed on the medium M. With such a configuration, the ear portion winding shaft 10 can wind up the ear portion Me while rolling by its own weight in the slacked region on the medium M. Therefore, with such a configuration, the printing apparatus 1 of this example achieves a simplified device configuration. Note that while the separation of the main body portion Mb and the ear portion Me can be easy or hard depending on the type of the medium M to be used, the main body portion Mb and the ear portion Me can be favorably separated by changing the degree of slackness of the medium M between the feed shaft 2 and the conveyance unit 20 and/or the weight of the ear portion winding shaft 10.

Example 7

Figure 11:
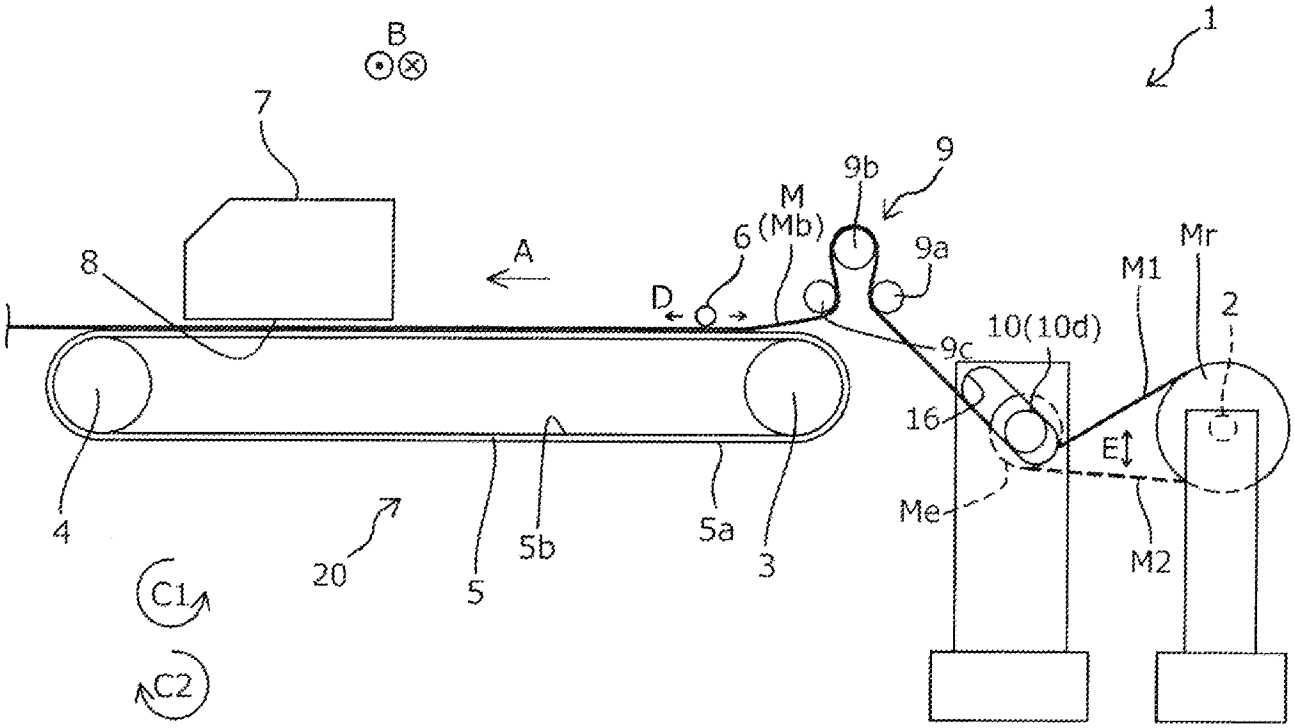
FIG. 11 is a schematic side view of a printing apparatus according to Example 7 of the present disclosure.

Next, the printing apparatus 1 of Example 7 is described with reference to FIG. 11. Note that FIG. 11 is a diagram corresponding to FIG. 1 of the printing apparatus 1 of Example 1. In FIG. 11, the same components as those of the above-described Example 1 to Example 6 are illustrated with the same reference symbols, and the description thereof is omitted. Here, the printing apparatus 1 of this example has the same configuration as that of the printing apparatus 1 of Example 6 except that a guide rail 16 is provided.

As illustrated in FIG. 11, the printing apparatus 1 of this example includes the guide rail 16 that movably supports the ear portion winding shaft 10. In this manner, the printing apparatus 1 of this example can suppress the occurrence of a cutting failure of the ear portion Me due to the ear portion winding shaft 10 disposed at a position deviated from a desired position.

Note that the disclosure is not limited to the aforementioned example, and many variations are possible within the scope of the disclosure as described in the appended claims. It goes without saying that such variations also fall within the scope of the disclosure.

What is claimed is:

1. A printing apparatus comprising:

a conveyance unit including a feed shaft, a driving roller, a driven roller, and a conveyance belt having an endless form, the feed shaft being configured to feed a medium by supporting and rotating the medium in a rolled form, the driving roller being configured to rotate in forward and reverse directions, the conveyance belt being stretched over the driving roller and the driven roller and configured to support the medium fed from the feed shaft, the conveyance unit being configured to convey the medium supported by the conveyance belt in a conveyance direction by rotating the driving roller forward;

a printing head configured to perform printing on the medium supported by the conveyance belt; and an ear portion winding shaft configured to wind up ear portions separated from the medium supported by the feed shaft, the ear portions being both end portions of the medium in a width direction orthogonal to the conveyance direction.

2. The printing apparatus according to claim 1, wherein the ear portion winding shaft is disposed at a position on a side opposite to the conveyance unit with respect to the feed shaft in the conveyance direction.

3. The printing apparatus according to claim 1, comprising:

a motor configured to rotate the ear portion winding shaft; and a medium detection sensor configured to detect the medium, wherein the medium detection sensor detects the medium at a predetermined height at a position between the ear portion winding shaft and the feed shaft in the conveyance direction, and wherein the motor switches between rotation and stop of the ear portion winding shaft in accordance with a switching timing between detection and non-detection of the medium by the medium detection sensor.

4. The printing apparatus according to claim 1, comprising:

a motor configured to rotate the ear portion winding shaft;

a winding diameter detection sensor configured to detect a winding diameter of the ear portion wound by the ear portion winding shaft; and a roll diameter detection sensor configured to detect a roll diameter of the medium supported by the feed shaft, wherein the motor is configured to control rotation of the ear portion winding shaft such that a height of the ear portion in a vertical direction is maintained at a predetermined height at a position between the ear portion winding shaft and the feed shaft in the conveyance direction, based on the winding diameter detected by the winding diameter detection sensor and the roll diameter detected by the roll diameter detection sensor.

5. The printing apparatus according to claim 1, comprising:

a motor configured to rotate the ear portion winding shaft;

a winding diameter detection sensor configured to detect a winding diameter of the ear portion wound by the ear portion winding shaft; and a calculation unit configured to calculate a rotational speed of the driving roller, wherein the motor is configured to control rotation of the ear portion winding shaft such that a height of the ear portion in a vertical direction is maintained at a predetermined height at a position between the ear portion winding shaft and the feed shaft in the conveyance direction, based on the winding diameter detected by the winding diameter detection sensor and a rotational speed of the driving roller calculated by the calculation unit.

6. The printing apparatus according to claim 1, comprising, as the ear portion winding shaft, a first ear portion winding shaft configured to wind up a first ear portion and a second ear portion winding shaft configured to wind up a second ear portion, the first ear portion being an end portion of the medium on one side in the width direction, the second ear portion being an end portion of the medium on another side in the width direction, wherein a position of at least one of the first ear portion winding shaft and the second ear portion winding shaft is changeable in accordance with a width of the medium, the width being a length in a direction that intersects the conveyance direction.

7. The printing apparatus according to claim 1, wherein the ear portion winding shaft is disposed at a position between the feed shaft and the conveyance unit in the conveyance direction.

8. The printing apparatus according to claim 7, wherein the medium is disposed in a slack state between the feed shaft and the conveyance unit in the conveyance direction, and the ear portion winding shaft is placed at the medium.

9. The printing apparatus according to claim 7, comprising a guide rail configured to movably support the ear portion winding shaft.

10. The printing apparatus according to claim 1, comprising a blade part configured to slit a boundary portion between the ear portion and a main body portion other than the ear portion in the medium supported by the feed shaft.

11. A printing method of a printing apparatus, the printing apparatus comprising:

a conveyance unit including a feed shaft, a driving roller, a driven roller, and a conveyance belt having an endless form, the feed shaft being configured to feed a medium by supporting and rotating the medium in a rolled form, the driving roller being configured to rotate in forward and reverse directions, the conveyance belt being stretched over the driving roller and the driven roller and configured to support the medium fed from the feed shaft, the conveyance unit being configured to convey the medium supported by the conveyance belt in a conveyance direction by rotating the driving roller forward;

a printing head configured to perform printing on the medium supported by the conveyance belt; and an ear portion winding shaft configured to wind up ear portions separated from the medium supported by the feed shaft, the ear portions being both end portions of the medium in a width direction orthogonal to the conveyance direction, the method comprising executing conveyance of the medium through rotation of the driving roller, feeding of the medium through rotation of the feed shaft, separation of the ear portion from a main body portion, and winding up of the ear portion through rotation of the ear portion winding shaft, when printing is performed with the printing head, by separating a part of the ear portion of the medium supported by the feed shaft from the main body portion in a state where a base end side of the ear portion is coupled with the main body portion, the main body portion being a portion other than the ear portion in the medium, and fixing a part on a top end side in the ear portion separated from the main body portion to the ear portion winding shaft, and supporting the main body portion at the conveyance belt.

* * * * *